United States Patent [19]

Iwakura

[11] 4,415,890

[45] Nov. 15, 1983

[54] CHARACTER GENERATOR CAPABLE OF STORING CHARACTER PATTERNS AT DIFFERENT ADDRESSES

[75] Inventor: Sadao Iwakura, Kawasaki, Japan

[73] Assignee: Canon Kabushiki Kaisha, Tokyo, Japan

[21] Appl. No.: 152,734

[22] Filed: May 23, 1980

[30] Foreign Application Priority Data

May 31, 1979 [JP] Japan ..... 54-73664[U]

[51] Int. Cl.[3] ..... G09G 1/16

[52] U.S. Cl. ..... 340/749; 340/748; 340/750; 340/744; 340/791

[58] Field of Search ..... 340/735, 790, 744, 748, 340/749, 750, 722, 799, 798, 791

[56] References Cited

U.S. PATENT DOCUMENTS

| | | | |
|---|---|---|---|
| 3,396,377 | 8/1968 | Strout | 340/750 |
| 3,422,420 | 1/1969 | Clark | 340/749 |
| 3,573,787 | 4/1971 | Sandgren et al. | 340/749 |
| 3,609,743 | 9/1971 | Lasoff et al. | 340/748 |
| 3,735,383 | 5/1973 | Naka | 340/750 |
| 3,781,850 | 12/1973 | Gicca et al. | 340/722 |
| 4,228,433 | 10/1980 | Matsumoto | 340/748 |

*Primary Examiner*—Marshall M. Curtis

*Attorney, Agent, or Firm*—Fitzpatrick, Cella, Harper & Scinto

[57] ABSTRACT

A character generator capable of storing character patterns at different addresses comprises a memory for storing character patterns corresponding to characters. Each of the character patterns includes a plurality of elements and one of the plurality of elements is stored apart from the remainder of the elements in the memory. A signal generator generates signals corresponding to the number of the plurality of elements and an address signal generator generates address signals for obtaining access to each of the character patterns stored in the memory. An address converter gains access to each of the character patterns stored in the memory in accordance with the address signals and the signals generated by the signal generator.

5 Claims, 6 Drawing Figures

| MODULO-5 COUNTER | | CHARACTER GENERATOR ADDRESS | | | | | | | | | | OUTPUT PATTERN |
|---|---|---|---|---|---|---|---|---|---|---|---|---|
| | C B A | AD9 | AD8 | AD7 | AD6 | AD5 | AD4 | AD3 | AD2 | AD1 | AD0 | |
| 0 | "0" "0" "0" | AS9 | AS8 | AS7 | AS6 | AS5 | AS4 | AS3 | AS2 | "0" | "0" | P1 COL |
| 1 | 0 0 1 | AS9 | AS8 | AS7 | AS6 | AS5 | AS4 | AS3 | AS2 | "0" | "1" | P2 COL |
| 2 | 0 1 0 | AS9 | AS8 | AS7 | AS6 | AS5 | AS4 | AS3 | AS2 | "1" | "0" | P3 COL |
| 3 | 0 1 1 | AS9 | AS8 | AS7 | AS6 | AS5 | AS4 | AS3 | AS2 | "1" | "1" | P4 COL |
| 4 | 1 0 0 | "1" | "1" | AS7 | AS6 | AS5 | AS4 | AS3 | AS2 | AS9 | AS8 | P5 COL |

CHARACTER GENERATOR CAPABLE OF STORING CHARACTER PATTERNS AT DIFFERENT ADDRESSES

BACKGROUND OF THE INVENTION

1. Field of the Invention

This invention relates to a character generator, and, more particularly, it is concerned with a character generator which increases the utility and efficiency of a pattern memory in storing character patterns therein.

2. Description of the Prior Art

There has so far been known a character generator which expresses character patterns with, for example, a dot matrix of 5 rows × 8 lines. The character patterns expressed by the 5×8 dot matrix are stored in an addressable memory, and can be called out from the memory by applying thereto an address signal to designate the desired character pattern. However, the character patterns thus stored in the memory are usually not output all at one time, but instead are output in several separate and distinct portions with the lines and rows of the dot matrix forming as a unit the entire character. For example, FIG. 1A of the accompanying drawing is a block diagram that explains a conventional character generator. In the drawing, a reference symbol CP designates a memory for storing character patterns therein, which selects one character pattern out of a plurality of character patterns stored therein in response to address signals AS3 to AS9 from address signal sources AL3 through AL9 CTN denotes a counter that designates a row (or column) of one character pattern thereby selecting a portion thereof. Here, the counter CTN is a quinary counter. The character address signal sources AL3 through Al9 select one of a plurality of character patterns out of the memory CP.

When the memory CP is accessed by the character address signal sources AL3 to AL9 and the counter CTN, the character patterns (A1 to A5, B1 to B5, P1 to P5 each representing one character pattern) should be disposed in the memory with a certain intervals among them as shown in FIG. 1B. Such necessity arises due to the fact that, while the addresses of the memory are all expressed in terms of a number of proceedings in computation, the counter CTN is just quinary. In more detail, while the quinary number can be expressed in three-bit, the octonary number can also be expressed in three-bit, on account of which there occurs a portion where no memory can be accessed by the counter CTN. Therefore, the character patterns should be arranged with certain intervals in the memory CP. In this regard, the address occupies a matrix of $8\times8=64$ bits, while it should primarily occupy a matrix of $5\times8=40$ bits for one character, causing a waste of $8\times3=24$ bits per one character. As the result, a memory having a capacity of 8,192 bits can only attain storage of $2^7\times8\times5=5120$ bits which correspond to 128 characters, whereby considerable portions in the memory remain unused. Therefore its working efficiency is poor and uneconomical.

SUMMARY OF THE INVENTION

It is therefore an object of the present invention to provide a character generator which has inproved on prior art apparatus by minimizing the aforedescribed disadvantages.

It is anohter object of the present invention to provide a character generator which is so constructed that arrangement of character patterns in the character memory may be changed, and an address converter logic circuit is provided that operates in conformity with the change in the arrangement of character patterns so that the patterns may be efficiently used.

The foregoing objects, other objects as well as specific construction and operations of the character generator according to the present invention will become more apparent from the following detailed description thereof, when read in conjunction with the accompanying drawings illustrating a preferred embodiment.

DETAILED DESCRIPTION OF PREFERRED EMBODIMENT

In the following, the present invention will be described in detail on the basis of one preferred embodiment thereof.

Figure 1A:
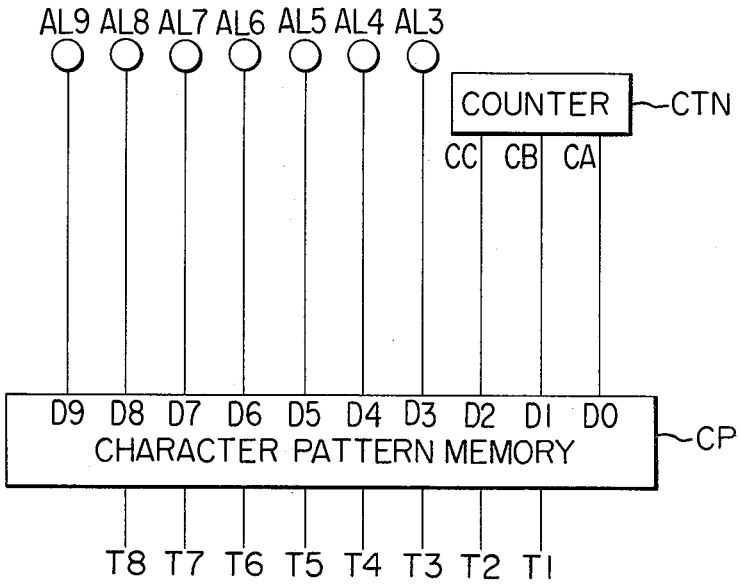
FIG. 1A PRIOR ART
FIG. 1A is a block diagram of a conventional character generator.
Figure 1B:
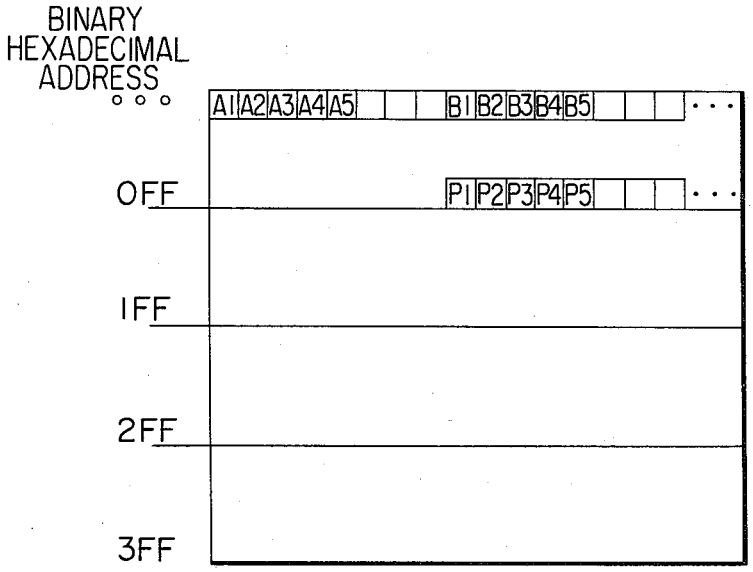
FIG. 1B PRIOR ART
FIG. 1B is a pattern arrangement in the character generator to be output by the circuit in FIG. 1A.
Figure 2A:
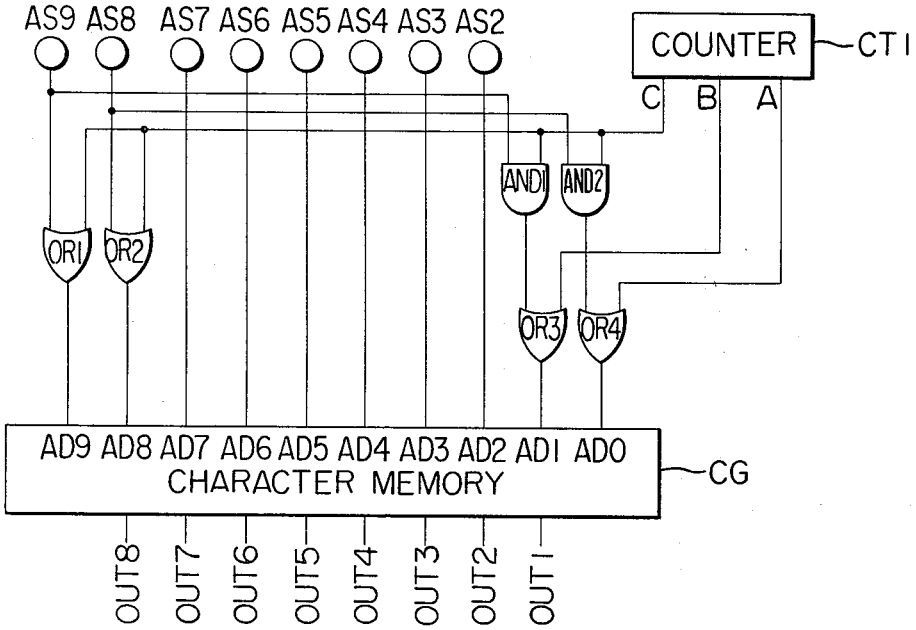
FIG. 2A is a block diagram showing one preferred embodiment of the character generator according to the present invention.
Figure 2B:
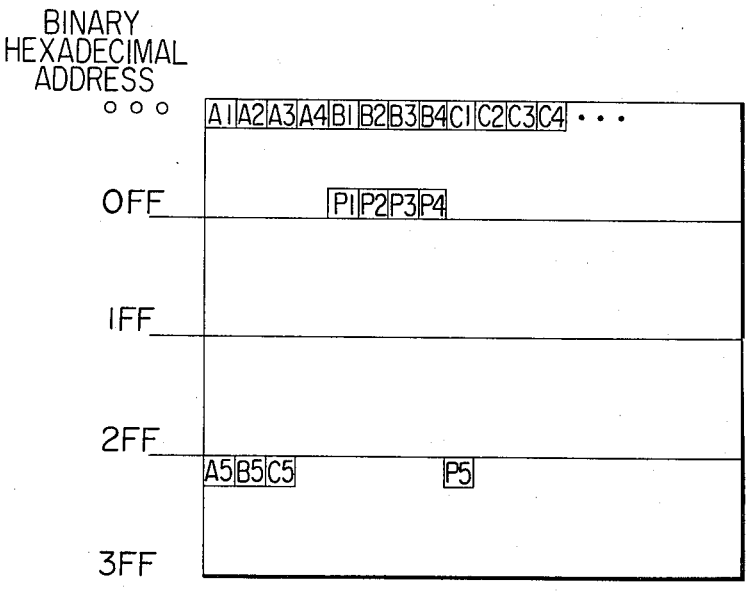
FIG. 2B is a pattern arrangement of the character generator to be output by the circuit shown in FIG. 2A.
Figures 3A, 3B:
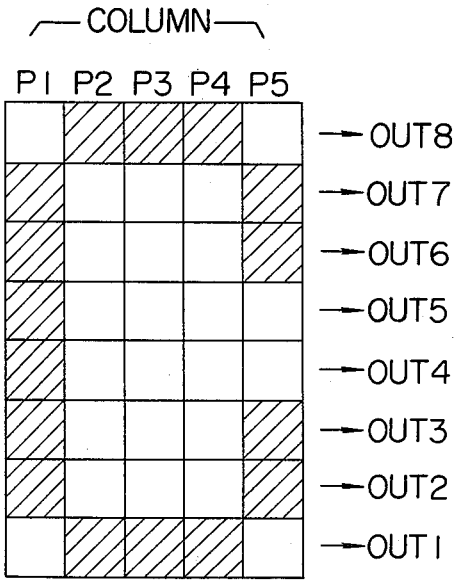
FIG. 3A is one concrete example of a pattern output.
FIG. 3B is a relative diagram of the address and the pattern output.

Referring first to FIG. 2A, AS2 to AS9 refer to address lines, to which address signals to select characters applied from a circuit (not shown) are introduced. CT1 refers to a counter, in which one character pattern is represented by a matrix of 5 columns × 8 lines as shown in FIG. 3A, and one column out of the five columns is sequentially selected to output a character pattern of 5 columns × 8 lines with the number of the column output at any one time being the unit counted by the counter CT1. Incidentally, the outputs A, B and C of the counter CT1 become greater in the sequence mentioned. OR1 to OR4 designate "OR" gates, and AND1 and AND2 designate "AND" gates. A logic circuit constructed with these OR1 to OR4 gates and AND1 to AND2 gates, accesses the memory which stores the character patterns therein. The memory is described later in greater detail. CG refers to a character memory, in which a plurality of character patterns are memorized. The character memory comprises, for example, a read-only memory. The character patterns are stored in the character memory CG in such a manner that one character part is stored in an address which is far distant from the other character part, as shown in FIG. 2B, without storing the character patterns corresponding to each character in a continuous address of the character memory CG. In the FIG. 2B, A1 to A5 denote one character pattern, the numerical figure suffix to the alphabetical letter representing a column of the character pattern as shown in FIGS. 3A and 3B. The character memory CG receives into its input terminals AD0 to AD9 those signals obtained by translating signals from the above-mentioned address lines AS2 to AS9 and the counter CT1 by the logic circuit, and produces output signals corresponding to those signals at the output terminals OUT1 to OUT8.

In the following, actual operation of the embodiment of the present invention in the above-mentioned construction will be explained with reference to FIG. 3B.

Assume now that address signals are applied to the address lines AS2 to AS9 to obtain certain character patterns stored in the character memory CG. In this instance, the counter CT1 has its content "0" as its initial state. The address of one character is given to the address lines AS9 to AS2. When the quinary counter CT1 has its content "0", the output C thereof is also "0", so that the signal entering into the input terminals AD9 and AD8 through the OR gates OR1 and OR2 are determined by the signals to the address lines AS9 and AS8. Also, the outputs from the AND gates AND1 and AND2 become "0" irrespective of the outputs from the address lines AS9 and AS8, whereby the outputs B and A of the quinary counter CT1 become the inputs to the input terminals AD1 and AD0 through the OR gates OR3 and OR4. Accordingly, when the counter CT1 has its content "0", the address signals as shown in FIG. 3B are applied to the input terminals AD9 to AD0 of the character memory CG, whereby the contents of the P1 column in FIG. 3A are produced as an output. When the content of the column P1 is shown in FIG. 2B, the content of the address shown by A1, for instance, is read out. Next, even when the content of the counter CT1 changes 1, 2, 3, etc. to read out the columns P2, P3, P4 etc. in FIG. 3A, the signals applied to the input terminals Ad9 to AD0 of the character memory CG are introduced under the same condition as that when the content of the counter CT1 is "0", since the output C from the counter maintains the "0" state. That is to say, the input terminals AD9 to AD2 are applied with signals from the address lines AS9 and AS2, as shown in FIG. 3B, and the signals B and A of the counter CT1 are applied to the input terminals AD1 and AD0. Accordingly, as shown in FIG. 2B, the character patterns A2, A3 and A4 are read out subsequent to A1. Next, when the last column P5 of the character pattern is read out, the counter CT1 has its content "4" and the output C of the counter becomes "1", whereby "1" is introduced as an input into the input terminals AD9 and AD8 of the character memory CG, and signals to be applied to the address lines AS9 and AS8 are introduced as inputs into the input terminals AD1 and AD0. Accordingly, the address of the character memory CG indicates 2FF and onward of the binary hexadecimal counting of the address in the pattern arrangement in FIG. 2B and thereby produces the output pattern of the column P5 in FIG. 3A.

As stated in the foregoing, since the character memory stores therein the character pattern, the utility of the memory improves.

What I claim is:

1. A character generator capable of storing character patterns at different addresses, comprising:

(a) memory means for storing character patterns corresponding to characters, each of said character patterns including a plurality of elements, an element of each plurality of elements comprising one of said character patterns being stored at a location in said memory means separate and spaced from the location of storage in said memory means of the remainder of said plurality of elements comprising said one of said character patterns;

(b) signal generating means for generating signals corresponding to the number of said plurality of elements;

(c) address signal generating means for generating address signals for obtaining access to each of said character patterns stored in said memory; and (d) address conversion means for gaining access to each element of each of said character patterns stored in said memory means in accordance with said address signals generated by said address signal generating means and the signals generated by said signal generating means.

2. A character generator as set forth in claim 1, wherein said address conversion means comprises arranging means for combining a portion of said address signals with said signals generated by said signal generating means.

3. A character generator as set forth in claim 2 wherein said arranging means comprises logic means.

4. A character generator as set forth in claim 1 or 2, wherein said signal generating means comprises counter means.

5. A character generator as set forth in claim 2, wherein said arranging means includes a circuit for combining more significant plural bits and less significant plural bits of said address signals with said signals generated by said signal generating means.

* * * * *